US007347332B2

(12) United States Patent
Hakola

(10) Patent No.: US 7,347,332 B2
(45) Date of Patent: Mar. 25, 2008

(54) CYCLONE HAVING A VIBRATION MECHANISM

(76) Inventor: Gordon R. Hakola, 7451 E. Beryl Ave., Scottsdale, AZ (US) 85258

( * ) Notice: Subject to any disclaimer, the term of this patent is extended or adjusted under 35 U.S.C. 154(b) by 216 days.

(21) Appl. No.: 11/291,281

(22) Filed: Dec. 2, 2005

(65) Prior Publication Data

US 2007/0125690 A1 Jun. 7, 2007

(51) Int. Cl.
*B04C 5/00* (2006.01)

(52) U.S. Cl. ..... 209/715; 209/159

(58) Field of Classification Search ..... 209/711, 209/712, 715, 717, 721, 728, 729
See application file for complete search history.

(56) References Cited

U.S. PATENT DOCUMENTS 4,149,861 A * 4/1979 Sogo et al. ..... 96/372
4,317,716 A * 3/1982 Liller ..... 209/732
4,341,352 A * 7/1982 Liller ..... 241/21
4,623,458 A * 11/1986 Hakola ..... 210/238
5,104,520 A * 4/1992 Maronde et al. ..... 209/210
7,255,790 B2 * 8/2007 Rogers et al. ..... 210/512.1
2004/0159613 A1 * 8/2004 Bair et al. ..... 210/726
2005/0155916 A1 * 7/2005 Tuszko et al. ..... 209/715

* cited by examiner

*Primary Examiner*—Patrick Mackey
*Assistant Examiner*—Kalyan Kumar
(74) *Attorney, Agent, or Firm*—Herbert E. Haynes, Jr.

(57) ABSTRACT

A cyclone for classifying materials has at least one vibrator attached to the downwardly tapering conical housing thereof to set up vibrations which interrupt the normal flow pattern of the downwardly swirling slurry of materials so that some of the smaller particles which would otherwise be trapped in the slurry are freed so that an increased amount of the smaller particles will move into the vortex created in the cyclone and thereby increase the operating efficiency of the cyclone. In a first embodiment, a conventional cyclone having a solid metallic conical housing is modified by having the vibrator attached to the periphery of the conical housing. In a second embodiment, an open-sided conical housing having a plurality of spaced apart longitudinal struts with the vibrator mounted on a strut which is configured to transmit vibrations to the metallic substrates of abrasion resistant liners mounted in the conical housing.

8 Claims, 3 Drawing Sheets

CYCLONE HAVING A VIBRATION MECHANISM

BACKGROUND OF THE INVENTION

1. Field of the Invention

This invention relates in general to cyclones and more particularly to cyclones having a vibration system for improving the separation of fines from the swirling slurry of materials being classified in the cyclone.

2. Description of the Prior Art

Cyclones are mechanisms that are used in various industries to separate different sized particles of materials that are fed as a slurry into the inlet of the cyclone. In the mineral processing industries such as for example in the processing of copper, iron ore, lead/zinc, gold, coal and the like, a plurality of large cyclones are typically carried in mounting bases arranged in a cluster over a "tub". Each of the cyclones are in circuit with grinding mills and a slurry formed of a liquid, often-times water, and the mineral to be classified is fed into the inlet of the cyclone. The larger, and therefore heavier materials in the slurry exit the cyclone through an underflow outlet at the bottom of the cyclone and are returned to the grinding mill for reprocessing and are subsequently returned to the cyclone. The smaller, and therefore lighter materials are carried upwardly in a vortex created within the cyclone and exit through an overflow outlet nozzle at its upper end.

The primary components of a cyclone include an inlet housing having a feed duct, a cylindrical head section, a head section cover plate with a vortex finder located centrally in the cover plate. A downwardly tapering conical housing depends from the head section and an apex cone is located at the lower end of the conical housing with the heavy material underflow outlet being connected to the lower end of the apex cone. The overflow outlet nozzle is coupled to the vortex finder and suitable ducts are provided to carry away the slurry containing the lighter materials. The internal surfaces of the various components of the cyclone are provided with replaceable liners which prevent them from being destroyed by the highly abrasive nature of the materials being classified therein.

The feed duct of a cyclone, which is often referred to as an involute, receives the slurry at high velocity from the grinding mill and directs it tangentially into the cylindrical inlet head section of the cyclone. As the slurry swirls around in the head section, centrifugal force will keep the slurry adjacent the sidewalls of the cyclone as it moves downwardly under the influence of gravity into the conical housing of the cyclone. Also, centrifugal force will cause the larger particles of the materials being classified to migrate to the outside of the slurry at a relatively rapid rate and the finer particles will migrate at a comparatively slower rate. Therefore, a portion of the finer particles will be carried in the inner portions of the slurry. The larger particles and the liquid carrying them will move downwardly through the apex cone and will exit the cyclone through the underflow outlet. The lighter materials located in the inner portion of the slurry along with the liquid carrying them will enter the vortex created within the apex cone and will move upwardly through the center of the conical housing into the vortex finder and exit the cyclone through the overflow outlet.

There is not a clear demarcation between the larger and smaller particles of the materials within the swirling slurry and some of the lighter particles are located within the outer portion of the slurry along with the larger particles. An undesirable amount of the lighter particles that are located in the outer portion of the slurry become trapped therein and exit the cyclone along with the larger particles through the underflow outlet of the cyclone. This keeps the operating efficiency of cyclones below an ideal level, which effects the entire system including the grinding mill, the pumps that supply the slurry to the cyclones and the cyclones themselves. The effects of low efficiency on the system effects the time, energy usage, and the costs for processing a given quantity of the materials being classified, and of course the longer a system operates the greater the wear on the system components.

To the best of my knowledge, no prior art mechanism or method has been devised to help release the smaller particles which become trapped in the downwardly spiraling slurry within a cyclone. Therefor, a need exists for a new and useful mechanism and method for use in a materials classifying cyclone to reduce the quantity of small particles trapped in the slurry so that they can enter the vortex of the cyclone rather than exiting therefrom along with the larger particles.

SUMMARY OF THE INVENTION

The present invention discloses cyclones having at least one vibrating device attached thereto which is operated to set up a vibration in the downwardly tapering conical housing of the cyclones. The vibrations are transmitted into the downwardly spiraling slurry of materials being processed in the cyclones to release some of the smaller particles which would otherwise remain trapped within the slurry.

In a first embodiment, a cyclone of conventional configuration is modified by having at least one vibrating device welded or otherwise affixed to the metal housing of the downwardly tapering conical housing thereof. Vibrations generated by the vibrating device are transmitted through the metal housing and the abrasion resistant liners of the conical housing into the slurry. In this manner the normal flow patterns of the slurry are interrupted by bouncing both the larger and smaller particles of the materials being classified off of the interior surface of the liners so that at least some of the smaller particles which would otherwise be trapped in the slurry will be free to enter the vortex created within the cyclone.

In a second embodiment, at least one vibrating device is mounted on an especially configured cyclone of the type disclosed in my co-pending U.S. patent application Ser. No. 11/087,998, Filed Mar. 24, 2005 for a Cyclone With In-situ Replicable liner Mechanism And Method For Accomplishing Same. This special cyclone includes, among other things, an open-sided downwardly tapering conical housing in place of the all metal housing of conventionally configured cyclones as discussed above in the first embodiment of the present invention. The open-sided conical housing includes a ring-shaped flange which circumscribes its open upper end and a sleeve at its lower apex end. The ring and sleeve are interconnected by a plurality of struts each of which is shown herein to be an assembly formed of a pair of angle beams arranged in a spaced apart relationship with liner support plates mounted there between. The abrasion resistant liners used in this open-sided cyclone are formed with metal substrates of truncated conical configuration with the abrasion resistant material bonded to the inner surface thereof. The liner support plates mounted in the strut assemblies are in engagement with the metal substrates of the abrasion resistant liners. As mentioned above, at least one vibrating device is mounted on this especially configured cyclone and this is accomplished by mounting the vibrating device on one of the strut assemblies. The vibrations generated by the vibrating device are transmitted through the angle iron beams and the liner support plates to the abrasion resistant liners to free some of the small particles trapped in the slurry in the manner hereinbefore described.

DESCRIPTION OF THE PREFERRED EMBODIMENTS

Figure 1:
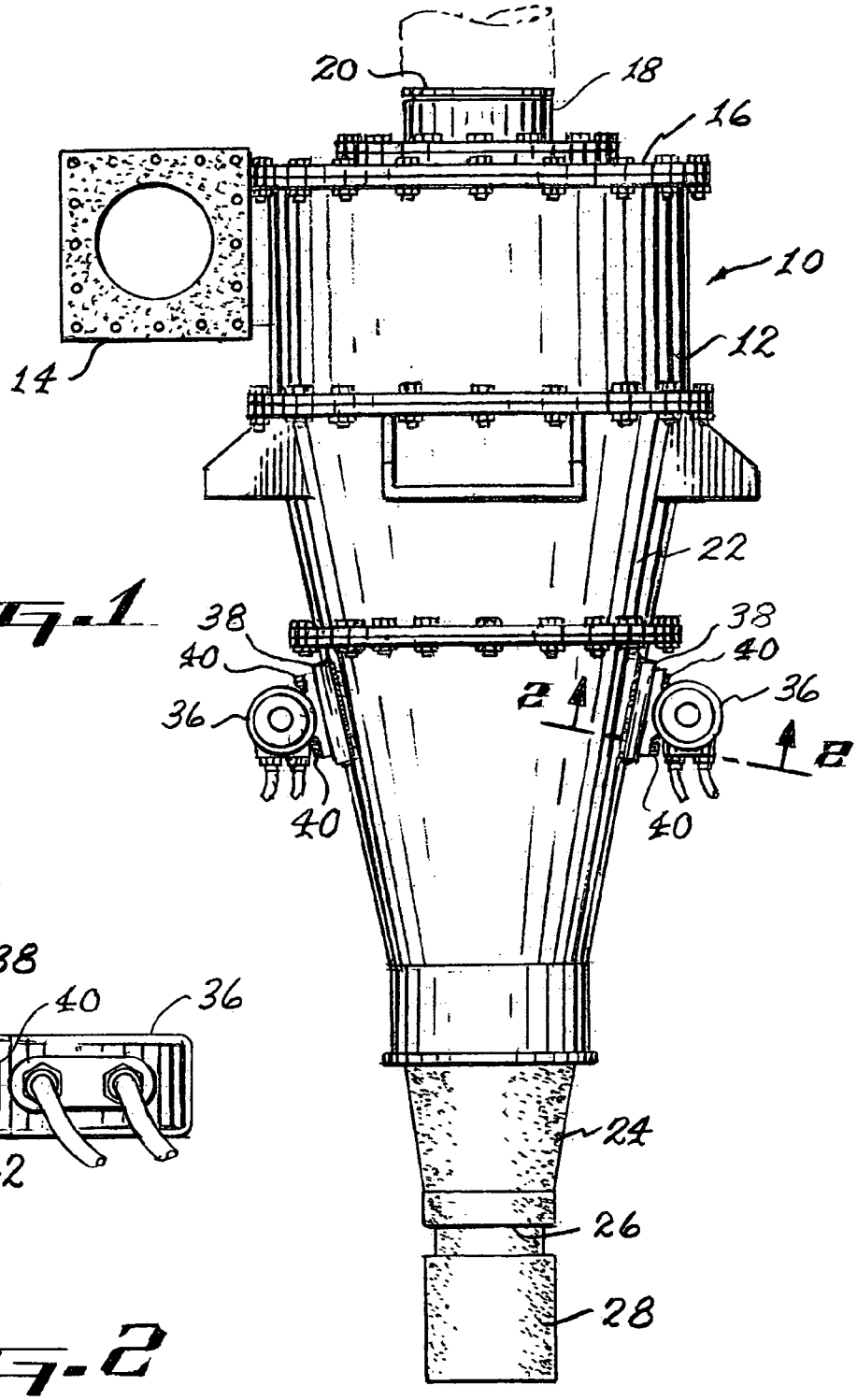
FIG. 1 is an elevational view of a conventionally configured cyclone which has been modified to include the vibrating mechanism in accordance with the present invention.

Referring more particularly to the drawings, FIG. 1 shows a cyclone which is indicated generally by the reference numeral 10. The cyclone 10 is of conventional configuration and is in common use especially in the mineral processing industry. The major components of the cyclone 10 include a cylindrical head section 12 having an inlet duct 14 through which the material to be classified is directed tangentially into the head section at high velocity. The head section 12 has a cover plate 16 closing its open upper end with a nozzle 18 extending upwardly from the cover plate to form the overflow outlet 20 of the cyclone 10. The head section 12 is open at its lower end and a downwardly tapering conical housing 22 depends therefrom. with an apex cone 24 extending through the open lower end of the conical housing to form the underflow outlet 26 of the cyclone 10. An optional anti-splash apron 28 can be mounted on the the lower end of the apex cone 24. It will be appreciated that the materials that are classified within cyclones are oftentimes abrasive and to minimize the destructive forces of an abrasive environment, they are provided with internally mounted abrasion resistant liners with a fragmentary portion of one of such liners 30 being shown in FIG. 2. Abrasion resistant liners of various types are used as determined by the type of materials being processed and by manufacturers preferences. The liner 30 shown in FIG. 2 includes a metallic substrate 32 of conical configuration with the abrasion resistant material 34 bonded to the interior surface thereof.

To insure a clear understanding of the present invention, a brief description of a typical material classification installation (not shown) and the operation of the cyclone 10 will now be presented. A cyclone is a mechanism that is used in various industries to classify, that is separate, different sized particles of materials that are fed as a slurry into the inlet of the cyclone. In the mineral processing industries such as for example in the processing of copper, iron ore, lead/zinc, gold, coal and the like, a plurality of large cyclones are typically carried in mounting bases arranged in a cluster over a "tub". Each of the cyclones are in circuit with grinding mills (not shown) and a slurry formed of a liquid, usually water, and the material to be classified is supplied to the cyclones. The inlet, or feed duct 14 of the cyclone 10, which is often referred to as an involute, receives the slurry at a high velocity and directs it tangentially into the cylindrical inlet head section 12 of the cyclone. As the slurry swirls around in the head section, centrifugal force will keep the slurry adjacent the sidewalls of the cyclone as it moves downwardly under the influence of gravity into the conical housing 22 of the cyclone. Also, centrifugal force will cause the larger and therefore heavier particles of the materials being classified to migrate to the outside of the slurry at a relatively rapid rate and the smaller and therefore lighter particles will migrate at a comparatively slower rate. Therefore, a portion of the smaller particles will be carried in the inner portions of the slurry. The larger particles and the liquid carrying them will move downwardly through the apex cone 24 and will discharged through the underflow outlet 26 of the cyclone 10. The portion of the smaller materials located in the inner portion of the slurry along with the liquid carrying them will enter a vortex that is created within the apex cone 24 and will move upwardly through the center of the conical housing 22, through the cylindrical head section 12 and will exit the cyclone 10 through the overflow outlet 20.

There is not a clear demarcation between the larger and smaller particles of the materials within the swirling slurry and some of the smaller particles are located within the outer portion of the slurry along with the larger particles. An undesirable amount of the smaller particles that are located in the outer portion of the slurry become trapped therein and exit the cyclone 10 along with the larger particles through the underflow outlet 26 of the cyclone and this keeps the operating efficiency of cyclone below an ideal level.

Figure 2:
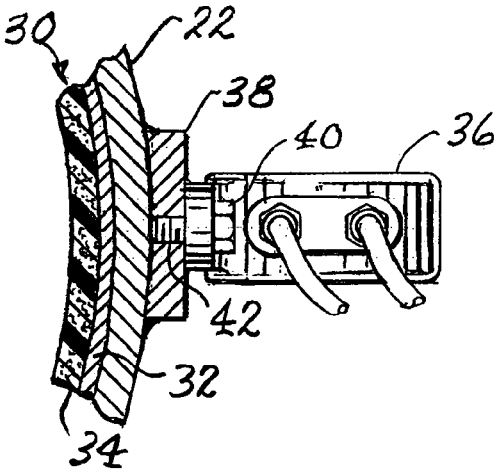
FIG. 2 is an enlarged fragmentary sectional view taken along the line 2-2 of FIG. 1.

In accordance with the present invention, the cyclone 10 is modified to include at least one vibrating device 36 which as best seen in FIG. 2, is affixed to the outer surface of the conical housing 22. The vibrating device 36, which may be affixed in any suitable manner, is shown as being attached to a nut plate 38 by bolts 40 which are mounted in threaded bores 42 (one shown) formed in the plate 38. The nut plate 38 is affixed to the conical housing 22 such as by welding. The vibrating device 36 is operated to set up vibrations in the metallic body of the conical housing 22 of the cyclone 10 and those vibrations are transmitted through the abrasion resistant liners 30 that are provided in the housing 22 into the downwardly spiraling slurry being processed in the cyclone 10. In this manner the normal flow patterns of the slurry are interrupted by bouncing both the larger and smaller particles of the materials being classified off of the interior surface of the liners 30 so that at least some of the smaller particles which would otherwise be trapped in the slurry will be freed to enter the vortex created within the cyclone 10.

Figure 3:
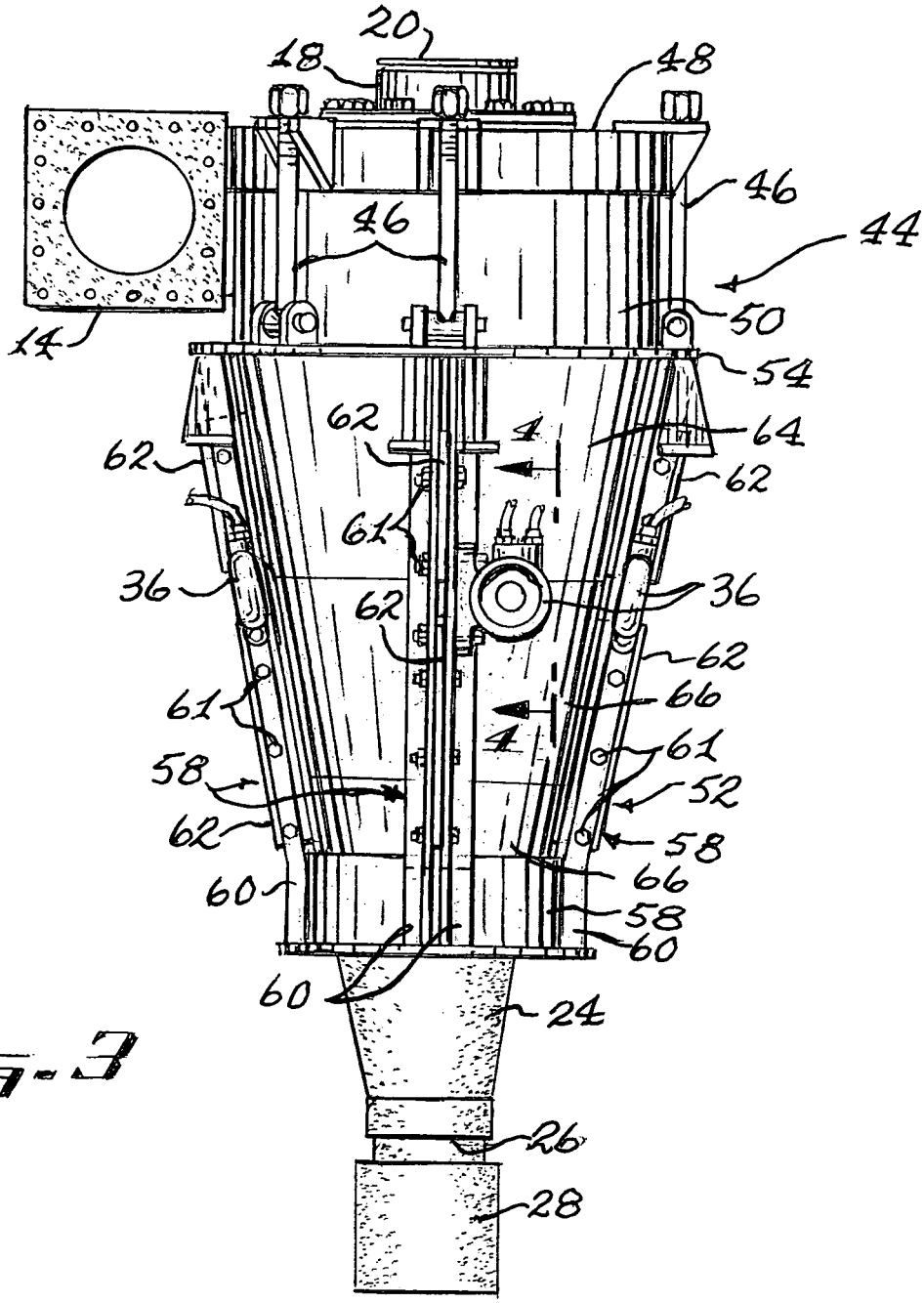
FIG. 3 is an elevational view of an especially configured open-sided cyclone with the vibrating mechanism mounted thereon in accordance with the present invention.

FIG. 3 shows a second embodiment as including a special cyclone 44 of the type disclosed in my previously mentioned co-pending U.S. Patent Application. This special cyclone 44 includes plurality of swing bolts 46, or other suitable means such as removable tension rods (not shown), which mount the cover plate 48 on the top of the head section 50 and also mount a special open-sided downwardly tapering conical housing 52 below the head section 50. The open-sided conical housing 52 includes a flange 54 which circumscribes its open upper end and a sleeve 56 at its lower apex end. The ring-shaped flange 54 and the sleeve 56 are interconnected by a plurality of strut means 58 which may be of any suitable configuration such as I-beams, circular in cross-section beams, or the like. Each of the struts are shown herein as an assembly formed of a pair of angle beams 60 connected to each other in a parallel spaced apart relationship by suitable bolts 61 with liner support plates 62 mounted there between. In that the sides of the conical housing 52 are open, the liners provided therein are seen to include an upper abrasion resistant liner 64, a middle abrasion resistant liner 66 and a lower abrasion resistant liner 68 with all three being of truncated conical configuration. As mentioned above in the description of the first embodiment, the abrasion resistant liners 64, 66 and 68 are preferably formed with metal substrates 70 having abrasion resistant material 72 bonded to the inner surface thereof as shown in the fragmentary sectional view of the liners 64 and 66 in FIG. 4.

Figure 4:
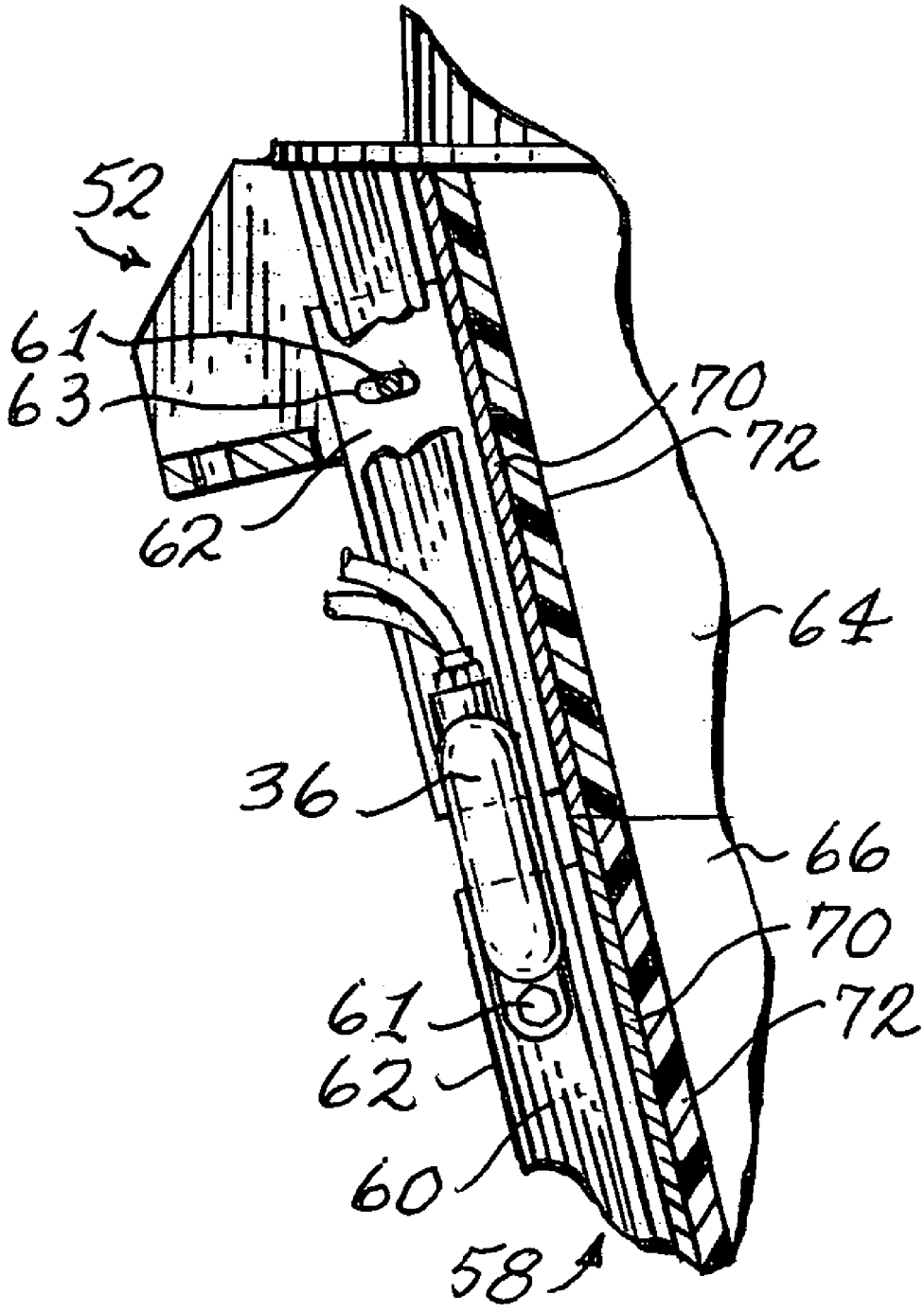
FIG. 4 is an enlarged fragmentary sectional view taken along the line 4-4 of FIG. 3.

The liner support plates 62 mounted in the strut assemblies 58 are shown in FIG. 4 as having slotted holes 63(one shown) through which the mounting bolts 61 pass to mount the plates in the strut assemblies. In this manner, the liner support plates 62 extend into engagement with the liners 64, 66 and 68 and are adjustable for centering and aligning the liners and provide contiguous engagement of the plates with the metal substrates 70 of the abrasion resistant liners. At least one vibrating device 36 is mounted by a pair of the bolts 61 on one of the strut assemblies 58. The vibrations generated by the vibrating device 36 are transmitted through the angle beams 60 of the strut assembly 58 on which it is mounted and the liner support plates 62 to the abrasion resistant liners 64, 66 and 68 to free some of the small particles trapped in the slurry in the manner hereinbefore described.

It is to be understood that several of the vibrators 36 can be mounted at various locations on the conical housing 22 of the cyclone 10 and on the strut assemblies 58 of the conical housing 52 of the cyclone 44. Further, the vibrators 36 may be electrically, hydraulically or pneumatically operated devices such as the vibrator model No. CV-35 marketed under the trademark VIBROLATOR by the Martin Engineering Company, One Martin Place Neponset Ill. 61345-9766.

While the principles of the invention have now been made clear in illustrated embodiments, many modifications will be obvious to those skilled in the art which do not depart from those principles. The appended claims are therefore intended to cover such modifications within the limits only of the true spirit and scope of the invention.

What I claim is:

1. A cyclone for classifying materials comprising:

a) a head section;

b) an inlet duct connected to said head section for directing the materials to be classified into said head section at high velocity;

c) a cover plate mounted on said head section and having a nozzle which forms an overflow outlet;

d) a conical housing of downwardly tapering configuration depending from the bottom end of said head section to receive the materials to be classified from said head section for classifying the received materials into relatively smaller and larger particles, said conical housing having open sides and including, i. a flange at the upper end of said conical housing, ii. a sleeve at the lower end of said conical housing, iii. a plurality of strut means interconnecting said flange and said sleeve and spaced apart relative to each other;

e) at least one vibrating device mounted on said conical housing for generating vibrations therein for increasing the amount of smaller particles classified in said conical housing;

f) means on said conical housing for mounting said vibrating device on one of said strut means of said conical housing; and g) a downwardly tapering apex cone extending from the bottom end of said conical housing for creating a vortex to carry the smaller particles of the materials classified in said conical housing upwardly through said conical housing and said head section and through the overflow outlet provided by said nozzle.

2. A cyclone as claimed in claim 1 and further comprising at least one abrasion resistant liner in said conical housing.

3. A cyclone as claimed in claim 2 wherein each of said of strut means comprises:

a) a pair of angle beams connected to each other in a parallel spaced apart relationship; and b) at least one liner support plate adjustably mounted between said angle beams for movement into aligning, centering and supporting engagement with said abrasion resistant liner.

4. A cyclone as claimed in claim 2 wherein said abrasion resistant liner comprises:

a) a metallic substrate of conical configuration; and b) abrasion resistant material bonded to the interior of said substrate to form said abrasion resistant liner into a two piece assembly.

5. A cyclone for classifying materials into relatively smaller and larger particles, said cyclone comprising:

a) a head section having an open bottom end;

b) an inlet duct connected to said head section for directing the materials to be classified tangentially into said head section at high velocity;

c) a cover plate mounted atop said head section;

d) a nozzle mounted in said cover plate to provide an overflow outlet;

e) a conical housing of downwardly tapering configuration depending from the open bottom end of said head section and having an open top for receiving the materials to be classified from said head section for classifying the received materials into relatively smaller and larger particles, said conical housing and having an open bottom end and having open sides, said conical housing including, i. a flange at the upper end of said conical housing, ii. a sleeve at the lower end of said conical housing, iii. a plurality of strut means interconnecting said flange and said sleeve and spaced apart relative to each other;

f) at least one vibrating device mounted on said conical housing for generating vibrations therein for increasing the amount of smaller particles classified in said conical housing;

g) means for mounting said vibrating device on one of said strut means of said conical housing; and h) a downwardly tapering apex cone mounted in the open bottom end of said conical housing for creating a vortex which carries the relatively smaller particles of the materials to be classified upwardly through said conical housing and said head section and through the overflow outlet provided by said nozzle, said apex cone having an open bottom end to provide an underflow outlet for discharging the relatively larger particles of the materials to be classified.

6. A cyclone as claimed in claim 5 and further comprising at least one abrasion resistant liner in said conical housing.

7. A cyclone as claimed in claim 6 wherein said abrasion resistant liner comprises:

a) a metallic substrate of conical configuration; and b) abrasion resistant material bonded to the interior surface of said metallic substrate to form said abrasion resistant liner into a two piece assembly.

8. A cyclone as claimed in claim 6 wherein each of said plurality of struts comprises:

a) a pair of angle beams being connected to each other in a parallel spaced apart relationship; and b) at least one liner support plate adjustably mounted between said angle beams for movement into aligning, centering and supporting engagement with said liner.

* * * * *